US005666844A

United States Patent [19]

Bieber

[11] Patent Number: 5,666,844

[45] Date of Patent: Sep. 16, 1997

[54] FLOOR-TYPE CLUSTER MILL, PREFERABLY WITH DIRECT HYDRAULIC ADJUSTMENT

[75] Inventor: Hermann Bieber, Georgensgmuend, Germany

[73] Assignee: Josef Fröhling GmbH, Olpe/Biggesse, Germany

[21] Appl. No.: 377,374

[22] Filed: Jan. 25, 1995

[30] Foreign Application Priority Data

Jan. 27, 1994 [DE] Germany ..... 44 02 398.7

[51] Int. Cl.[6] ..... B21B 31/07

[52] U.S. Cl. ..... 72/238; 72/242.4

[58] Field of Search ..... 72/238, 239, 242.4, 72/224, 225, 247

[56] References Cited

U.S. PATENT DOCUMENTS

| | | | |
|---|---|---|---|
| 3,858,424 | 1/1975 | Kajiwara et al. | 72/242.4 |
| 4,805,433 | 2/1989 | Rennebaum | 72/242.4 |
| 5,218,852 | 6/1993 | Watanabe et al. | 72/242.4 |

*Primary Examiner*—Lowell A. Larson
*Assistant Examiner*—Ed Tolan
*Attorney, Agent, or Firm*—Levine & Mandelbaum

[57] ABSTRACT

The present invention pertains to a floor-type cluster mill with a set of rolls above the nip and a corresponding set of rolls under the nip, and preferably with direct hydraulic adjusting means. The cluster mill is characterized by the possibility of conversion between a 14-roll mill and a 20-roll mill, wherein each set of rolls has, in both cases, a number of rolls that are to be maintained unchanged and a number of rolls that are to be replaced.

6 Claims, 3 Drawing Sheets

FIG.3
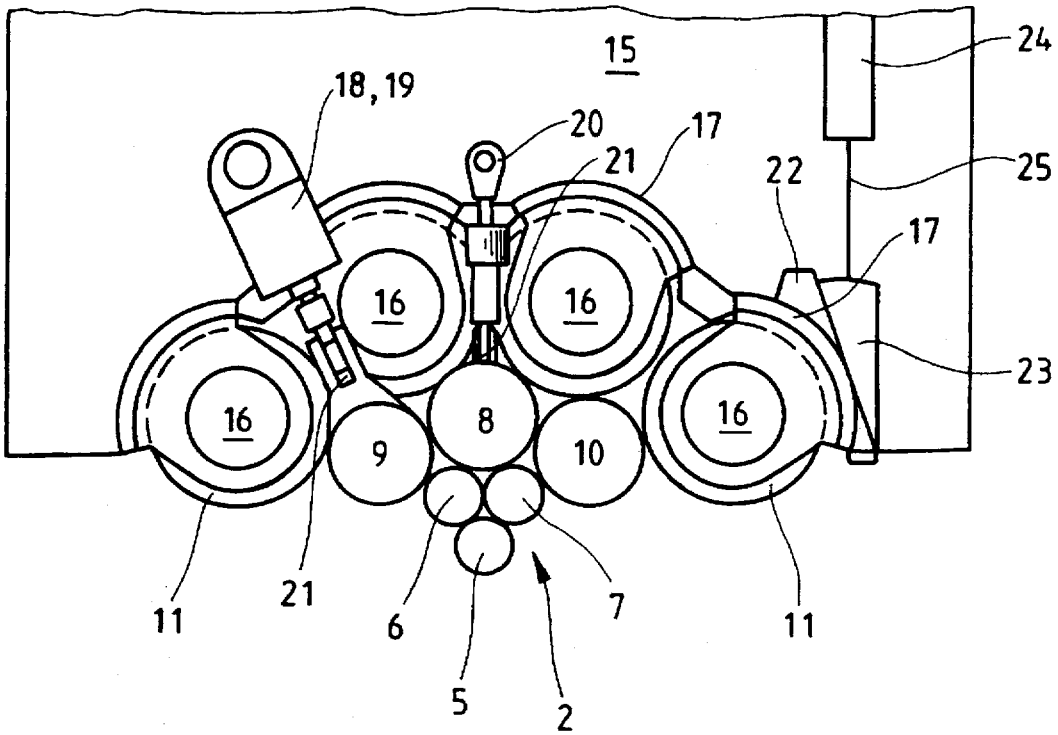
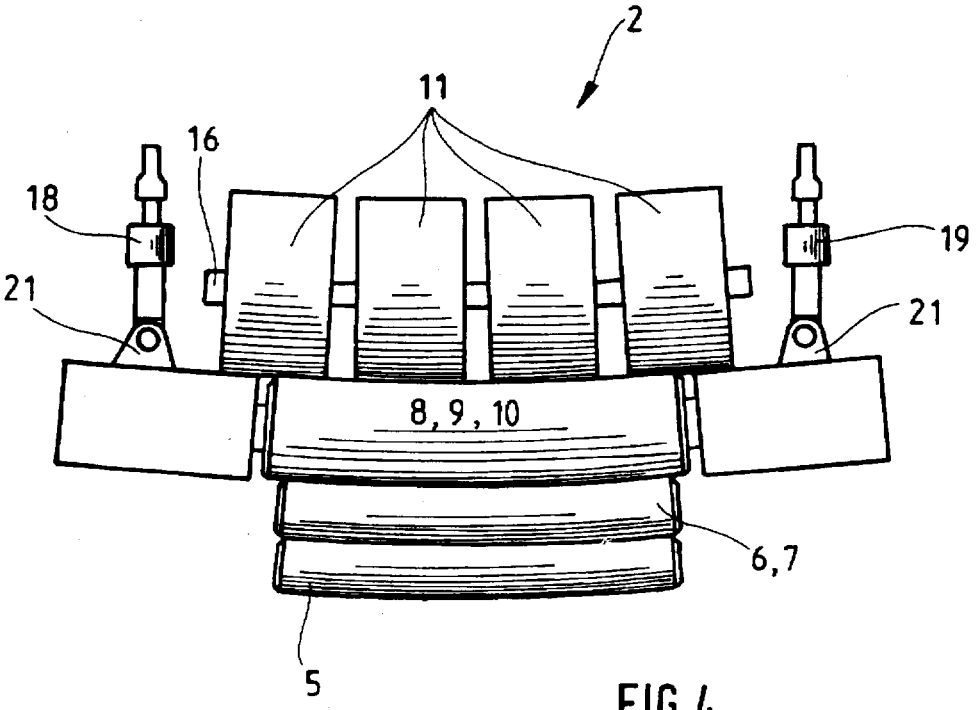
FIG.4

FLOOR-TYPE CLUSTER MILL, PREFERABLY WITH DIRECT HYDRAULIC ADJUSTMENT

BACKGROUND OF THE INVENTION

The rolling of high-strength materials to the smallest final thicknesses requires the smallest possible working roll diameters for technical reasons in terms of shaping as well as for economic reasons. The prior-art cluster mills have proved to be suitable for these applications. The existing and increasing demand for steel strips of the smallest possible final thickness was one of the reasons behind the development of high-speed 12- and 20-roll mills. The essential feature of these cluster mills is, besides the number of rolls, the direct hydraulic adjustment, with which even very narrow strip thickness tolerances can be guaranteed. Adjusting mechanisms exerting qualitatively different actions on the nip contour are available for controlling or regulating the surface evenness of the strip. The rolls and support axles with supporting rollers are arranged in two bearing housings which are vertically movable independently from one another. Their displacement makes it possible to compensate large amounts of roll wear and even different working roll diameters, which can be optimally used within narrow limits. The latter possibility, i.e., the use of different working roll diameters, as well as the relatively high roll speeds make cluster rolls appear attractive even for broad strip thickness ranges. Twenty-roll mills offer advantages in rolling thin, hard materials because of their small working roll diameter relative to their surface length.

Both 12-roll and 20-roll mills have two sets of rolls with working rolls at the ends of the two sets of rolls facing each other, which limit the nip and act on the material being rolled from two sides. With the exception of the working roll, each set of rolls has a number of inner intermediate rolls and outer supporting rollers, on which the working roll is supported. Direct adjustment in 20-roll mills makes it possible to optionally install working rolls with diameters at ratios of up to approx. 2.5, e.g., with diameters between 30 and 70 mm, without additional conversion measures and especially without changing the number of rolls.

The type of the roll mill, e.g., two-, four- or 20-roll mills, are to be selected corresponding to the rolling task, i.e., as a function of the strip width, the minimum and maximum strip thicknesses, the strip material, etc.

It has also been known in connection with rolling to the smallest possible final thicknesses that different types of mills, which fulfill different tasks, can be used in multistep rolling processes. It has been known, e.g., that it is possible to use cluster mills with 12 or 20 rolls and working rolls with small diameters to arrive at a very small final width of, e.g., 0.01 mm or 0.05 mm, and subsequently to subject the surface of the rolled stock to sizing by passing the rolled stock through a mill of a relatively large diameter without causing any substantial additional change in the final thickness reached with the cluster mill, in an economical manner, i.e., in the smallest possible number of passes, from a relatively great initial thickness.

The relationship between the number of rolls and the roll diameter can be explained most simply by thinner working rolls, i.e., working rolls with a smaller diameter showing a stronger tendency than thicker rolls to whip and by a better support of the working rolls being therefore necessary, i.e., in order to avoid the whipping, which requires the use of a larger number of supporting and intermediate rolls. This means that two- and four-roll mills are used for sizing with the thicker rolls.

The types of cluster mills used to date have a set number of rolls. A 12-roll mill always operates with 12 rolls, and a 20-roll mill always operates with 20 rolls. This means that two different mills must be used in the case of a first rolling process, in which a very small final thickness from a relatively thick starting material is reached in one pass or at most in a few roll passes and surface finishing is necessary. First, a cluster mill with, e.g., 20 rolls, of which the working rolls are very thin, is needed for reducing the thickness of the rolled stock, and a mill containing only a few rolls is needed, in which the working rolls have a relatively large diameter.

SUMMARY OF THE INVENTION

The task of the present invention is to design a cluster mill such that it can be used to carry out jobs which were carried out on a 20-roll mill before, but also jobs which require a larger working roll diameter than is possible in a 20-mill. In other words, the task of the present invention is to provide a cluster mill that offers the advantages of a cluster mill, e.g., of a 20- roll mill, but which can be converted with simple means such that it can also be economically used for rolling thicker strips or even as a sizing mill.

Thus, as a result, the present invention provides a mill which is a 20-roll mill and can be equally used for all jobs for which the 20-roll mills are intended, but with which it is also possible to reduce rolled stock to a final thickness that is, e.g., at least in the range of 0.10 mm. However, after a relatively simple conversion, the mill can also be used to carry out jobs for which other mills were used before, at nearly the same efficiency. The design as a 20-roll mill with a larger number of rolls offers good conditions for ensuring that the number of supporting rollers remaining in the mill in the case of conversion to sets of rolls with working rolls with larger diameters will still sufficiently support the working rolls with larger diameter, i.e., the working rolls that impose less stringent requirements on supporting, but, on the other hand, it is possible to remove so many supporting rollers that working rolls with larger diameters can be installed.

However, on the other hand, a mill with a substantially broader field of use has been created. If the mill is outfitted as a 20-roll mill, it can be used to optimally perform rolling processes that require the use of modern 20-roll mills, i.e., it is possible, in particular, to roll rolled stock to very small final thicknesses in an optimal manner. No concessions need to be made compared with a 20-roll mill of standard design. If the same mill is converted to a 14-roll mill at a lower expense, which can be done rather easily in light of the above-described situation, the conditions needed for sizing are almost reached. This means that hardly any concessions need to be made compared with a special sizing mill. However, the field of use of the mill according to the present invention can again be considered to be expanded, because final thicknesses in the range of 0.10 mm can be reached in the outfitting as a 20-roll mill, after which the mill is converted to a 14-roll mill, and the rolled stock, which was rolled before to the desired final thickness with the very thin working rolls, which final thickness can be readily reached with the 20-roll mill, is subjected to surface finishing, which is sufficient for a great number of applications, by the use of the far less thin working rolls of the 14-roll mill without an additional reduction in thickness. Consequently, a rolling mill must make a somewhat larger investment with the purchase of a mill according to the present invention than when purchasing a 20-roll mill only, but it can cover the working range of two types of mills with one machine, so that the solution according to the present invention will ultimately represent the more economical solution. Mowever, if optimal sizing is carried out with a usual mill with, e.g., two or four rolls, and the rolling mill operator purchases a special machine for this, it can be used to process rolled stock that originates from only one machine according to the present invention, whereas it originates from two different mills according to the current technique. Consequently, a problem solution that is more economical from a number of viewpoints is possible with the present invention.

DESCRIPTION OF THE DRAWINGS

The present invention will be explained in greater detail below on the basis of the drawing, wherein

FIGS. 3 and 4 show a (partially cutaway) side view of an embodiment of the upper part of a mill (FIG. 3) and a cross-sectional view of this upper part (FIG. 4).

DESCRIPTION OF THE PREFERRED EMBODIMENT

Figure 1:
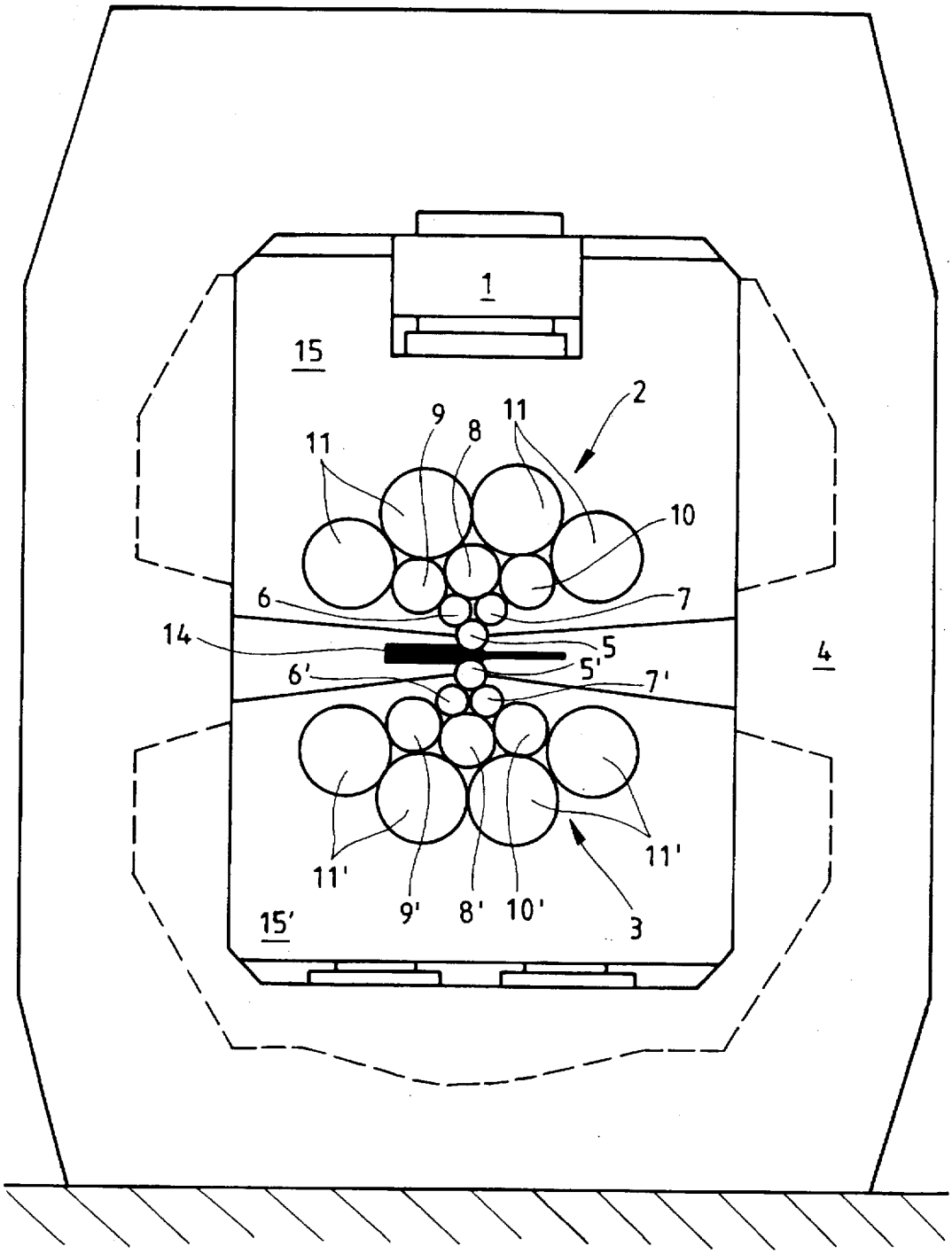
FIG. 1 shows a mill outfitted as a 20-roll mill.

The mill is a floor-type mill with direct hydraulic adjustment. The hydraulic adjusting means is designated by reference number 1. The adjusting means 1 offers the advantage that a minimum/maximum possible working roll diameter can be selected within a certain limit based on the adjusting stroke that is freely selectable within broad ranges. The limit is determined by the geometry of the two sets of rolls 2, 3. A design as a 20-roll mill with working roll diameter ratios of up to 2.8, which has already been realized in prior-art mills, is also feasible; these prior-art mills are designed exclusively as 20-roll mills, and working rolls 5, 5', whose diameters may be, e.g., between 30 and 70 mm, can be used.

The cluster mill according to the present invention is designed as a 20-roll mill in the outfitting according to FIG. 1. The hydraulic adjusting means 1 is arranged at the top in the frame 4 of the mill, and the hydraulic adjusting means acts directly on the upper bearing housing 15 with the upper set of rolls 2, which acts with the working roll 5 on the top side of the rolled stock 14 and limits the nip 14' from the top, on the one hand, and a working roll 5' of a lower set of rolls 3 acts on the underside of the rolled stock 14 and limits the nip 14' from below. The working rolls 5, 5', the inner intermediate rolls 6, 7 as well as 6', 7', the outer intermediate rolls 8, 9, 10 as well as 8', 9', 10' and the supporting rollers 11 and 11' of the upper set of rolls 2 and of the lower set of rolls 3 correspond to the state of the art, so that they need to be specifically discussed only as it is done in connection with FIGS. 3 and 4. The bearing housings 15, 15' of the two sets of rolls 2 and 3 are arranged adjustably in relation to one another in the mill in order to bring the lower set of supporting rollers 3 to pass line height, on the one hand, and to open the nip 14' to different widths, on the other hand. The adjusting means 1 and the drives are designed correspondingly; the rotary movement of the rolls and rollers is brought about by a drive that is of the usual design in itself, like the adjusting means, and therefore is not shown.

It shall be pointed out regarding the rolls 5 through 10 as well as 5' through 10', on the one hand, and the rollers 11, 11', on the other hand, that all the rolls 5 through 10 as well as 5' through 10' are made in one piece, continuously from one end to their other end, to form working rolls and intermediate rolls, while the supporting rollers are designated by 11 and 11', and they are not made in one piece continuously from one end to their other end, even though their length corresponds to that of the working rolls and intermediate rolls, but they consist of individual rollers, which are nonrotatably associated with a shaft 16 next to each other at relatively closely spaced locations from one another, so that the supporting rollers 11, 11' are called sets of rollers or sets of supporting rollers in practice.

Figure 2:
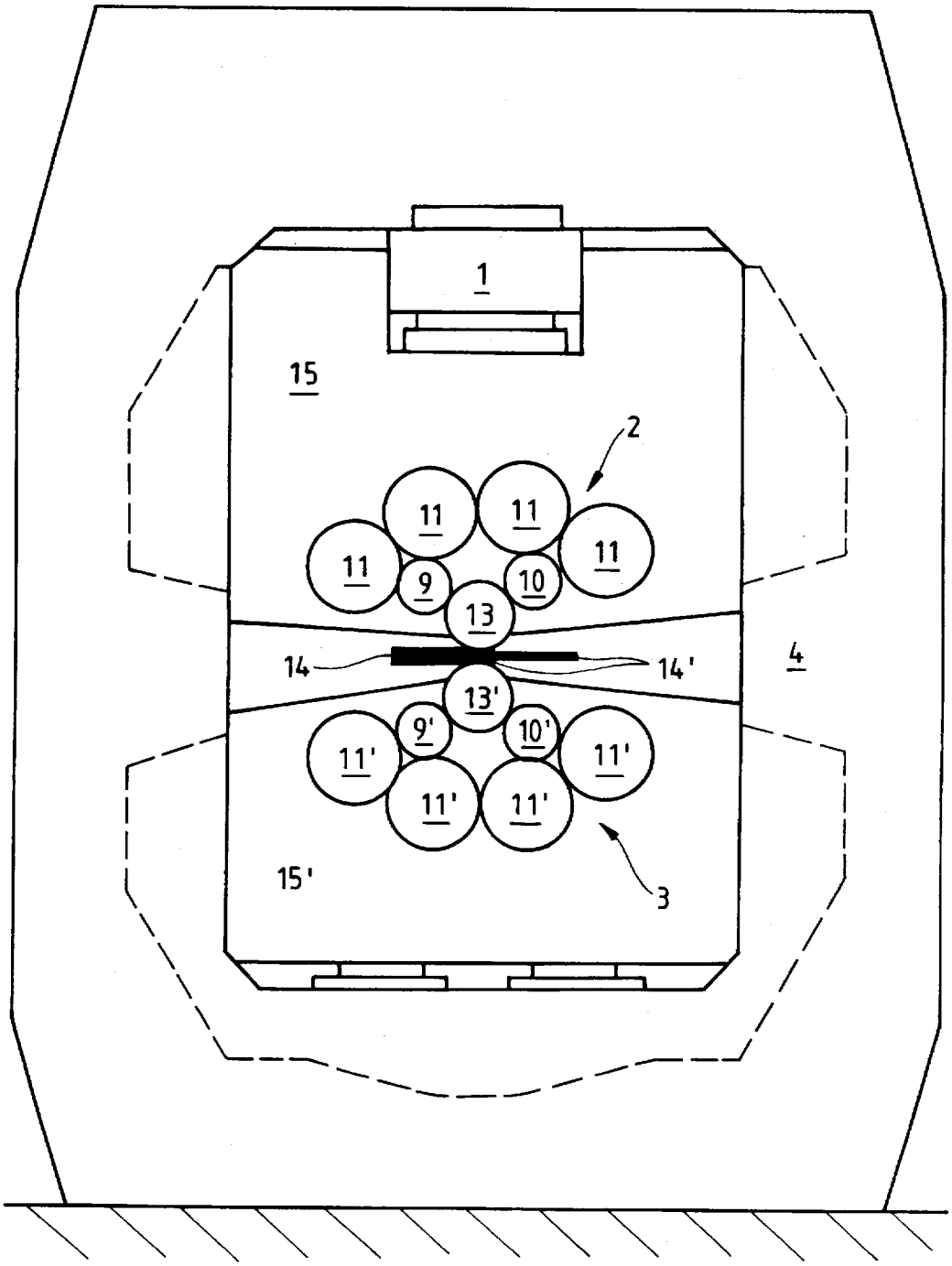
FIG. 2 shows the same mill after conversion to a 14-roll mill; the mill is shown schematically in both cases, viewed in the direction of the axes of rotation of the rolls.

According to the present invention, the mill can be converted from a 20-roll mill according to FIG. 1 to a 14-roll mill according to FIG. 2. To do so, the group of rolls 5 through 8 as well as 5' through 8' of each respective set of rolls 2 and 3 is removed and replaced with an individual working roll 13 and 13' each with correspondingly larger diameter in the respective bearing housing 15 and 15'. In each set of rolls 2 and 3, the working roll 13 and 13' is supported on the rolls 9, 10 as well as 9' 10'. Consequently, an essential feature of the present invention is the coordination between the roll groups 5 through 8 and 5' through 8', on the one hand, and the working roll 13 and 13', on the other hand, in the corresponding set of rolls 2 and 3, and the possibility of mounting them in lateral positions or bearing housings of the mill such that the working rolls act on the rolled stock 14' in the nip 14 and their proper support is possible and guaranteed in each of the two cases. Consequently, as many rolls can be removed from the 20-roll mill that space is created for two rolls of large diameter.

Consequently, if the mill according to the present invention is initially outfitted as a 20-roll mill, as many rolls, including the working rolls 5, 5', can be removed so that space is created for two working rolls 13, 13' of correspondingly larger diameters. Nevertheless, so many rolls remain in both sets of rolls 2, 3 that they are sufficient for the thicker working rolls 13, 13', which are consequently less prone to whipping.

In FIGS. 3 and 4, the upper part or the upper housing of a cluster mill according to the present invention is designated by 15, so that the set of rolls shown is the upper set of rolls 2 according to FIGS. 1 and 2, and it is assumed that the cluster mill is outfitted as a 20-roll mill according to FIG. 1. The lower set of rolls 3 is consequently designed correspondingly.

The set of supporting rollers consisting of the rollers 11 and the supporting axles 16 is supported on the bearing housing 15 by means of saddle pieces 17, and the saddle pieces can be adjusted independently from one another by means of adjusting means, which consist of, e.g., one pair of wedges 22, 23 each, with a piston-and-cylinder unit 24, 25 acting on the adjusting part 23 supported on the housing 15, wherein the other adjusting part 22 is associated with the corresponding saddle piece 17. Such an adjusting means, which operates independently from the adjusting means of the other adjusting parts, is associated with each saddle piece.

The lateral rolls of the intermediate rolls 9, 10 are mounted on the bearing housing 15 adjustably by piston-and-cylinder units 18, 19, and only the two units 18, 19 for the lateral outer intermediate roll lateral own, but the other lateral outer intermediate roll 10 is mounted correspondingly. The central outer intermediate roll 8 is mounted correspondingly on a piston-and-cylinder unit 20.

The piston-and-cylinder units 18, 19 and 24, 25 as well as 20 are articulated to the bearing housing 15. The inner intermediate rolls 6, 7 are also articulated to the bearing housing 15 (not shown in FIG. 3); the working roll 5 is inserted loosely between the rolled stock 14 and the intermediate rolls 6, 7. The working roll 13 may be suspended by means of a piston-and-cylinder unit similar to the piston-and-cylinder unit 20.

It should finally be pointed out that modifications are possible without causing any change in the essence of the present invention. Such modifications include especially that the hydraulic adjusting means 1 acts on the lower bearing housing 15' instead of on the upper bearing housing 15.

What is claimed is:

1. In a floor-type cluster mill for working a high strength material, said mill including a frame, an upper set of rolls rotatably mounted relative to said frame, one roll of said upper set of rolls being an upper working roll, a lower set of rolls rotatably mounted relative to said frame, one roll of said lower set of rolls being a lower working roll mounted in spaced relationship to said upper working roll, the space between said upper working roll and lower working roll being in a path for passage of said material, each roll of said upper set engaging another roll of said upper set, and each roll of said lower set engaging another roll of said lower set, the improvement further comprising a first changeable subset of rolls removably mountable with respect to said frame, and a second changeable subset of rolls removably mountable with respect to said frame, at least one of said upper set and lower set comprising a permanent subset of rolls rotatably mounted with respect to said frame, and alternatively, either said first changeable subset of rolls or said second changeable subset of rolls, said changeable subset having a first number of rolls including a working roll with a first diameter, said second changeable subset having a second number of rolls less than the first number of rolls, and including a working roll with a second diameter greater than said first diameter.

2. A floor-type cluster mill in accordance with claim 1, wherein the combined number of rolls in said upper set and lower set is 14, making said mill a 14 roll mill when said second set is selected as said changeable subset or the combined number of rolls in said upper set and lower set is 20, making said mill a 20 roll mill when said first set is selected as said changeable subset.

3. A floor-type cluster mill in accordance with claim 2, wherein each of said upper and lower sets of rolls comprises a plurality of outer supporting rolls located distal from said path, and a plurality of intermediate rolls each of which is in engagement with at least one adjacent supporting roll and disposed between the supporting rolls and its respective working roll, wherein the supporting rolls of each of the upper and lower sets of rolls are the same in size and number both when the mill is a 14-roll mill and the mill is a 20-roll mill.

4. A floor-type cluster mill in accordance with claim 2, wherein each of said upper and lower sets of rolls comprises a plurality of outer supporting rolls located distal from said path, and a plurality of intermediate rolls each of which is in engagement with at least one adjacent supporting roll and disposed between the supporting rolls and its respective working roll both when the mill is a 14-roll mill and when the mill is a 20-roll mill, and further comprising an additional intermediate roll in engagement with at least one adjacent supporting roll and disposed between the supporting rolls and its respective working roll when the mill is a 20-roll mill, said additional intermediate roll being absent when the mill is a 14-roll mill.

5. A floor-type cluster mill in accordance with claim 4, wherein when the mill is a 14-roll mill, two of the intermediate rolls in each of said upper and lower sets of rolls engage adjacent ones of said supporting rolls and said respective working roll.

6. A floor-type cluster mill in accordance with claim 4, wherein when the mill is a 20-roll mill, adjacent ones of said intermediate rolls engage one another and adjacent supporting rolls, and further comprising a plurality of inner rolls in engagement with adjacent ones of said intermediate rolls and the respective working roll.

* * * * *